US005561036A

United States Patent [19]

Singer et al.

[11] Patent Number: 5,561,036

[45] Date of Patent: Oct. 1, 1996

[54] PHOTOGRAPHIC ELEMENTS CONTAINING SCAVENGERS FOR OXIDIZED DEVELOPING AGENT

[75] Inventors: Stephen P. Singer, Spencerport; Ronald E. Leone, Rochester, both of N.Y.

[73] Assignee: Eastman Kodak Company, Rochester, N.Y.

[21] Appl. No.: 413,746

[22] Filed: Mar. 30, 1995

[51] Int. Cl.[6] ..... G03C 1/08; G03C 7/26; G03C 7/32

[52] U.S. Cl. ..... 430/551; 430/504; 430/505

[58] Field of Search ..... 430/502, 503, 430/551, 372, 505, 504

[56] References Cited

U.S. PATENT DOCUMENTS

| | | | |
|---|---|---|---|
| 2,675,314 | 4/1954 | Vittum et al. | 430/372 |
| 4,175,968 | 11/1979 | Credner et al. | 430/559 |
| 4,252,893 | 2/1981 | Iwamuro et al. | 430/551 |
| 4,476,219 | 10/1983 | Sakanoue et al. | 430/542 |
| 5,264,332 | 11/1993 | Otani et al. | 430/508 |

FOREIGN PATENT DOCUMENTS

| | | |
|---|---|---|
| 61-248042 | 11/1986 | Japan . |

*Primary Examiner*—Geraldine Letscher
*Attorney, Agent, or Firm*—Alfred P. Lorenzo

[57] ABSTRACT

An improved photographic element comprises a support bearing at least one silver halide emulsion layer having associated therewith a hydroquinone compound that functions as a scavenger for oxidized developing agent. The hydroquinone compound has sufficient bulk that it is substantially non-diffusible in the photographic element and has in the two-position thereof an asymmetric tertiary carbamoyl substituent. These scavenger compounds exhibit very high activity, have excellent stability upon long-term storage and do not leave colored residues after processing.

19 Claims, No Drawings

PHOTOGRAPHIC ELEMENTS CONTAINING SCAVENGERS FOR OXIDIZED DEVELOPING AGENT

CROSS-REFERENCE TO RELATED APPLICATIONS

Commonly-assigned U.S. patent application Ser. No. 388,912, filed Feb. 15, 1995, "Photographic Elements Containing Scavengers For Oxidized Developing Agent" by Stephen P. Singer and Ronald E. Leone describes pyrocatechol compounds that function as scavengers for oxidized developing agent, the pyrocatechol compounds having sufficient bulk that they are substantially non-diffusible in a photographic element and having in the four-position thereof a tertiary carbamoyl substituent.

FIELD OF THE INVENTION

This invention relates in general to photography and in particular to photographic elements comprising at least one radiation-sensitive silver halide emulsion layer. More specifically, this invention relates to improved photographic elements containing compounds which act as scavengers for oxidized developing agent.

BACKGROUND OF THE INVENTION

It is known in the art to add a scavenger to a photographic element in order for the scavenger to prevent oxidized developing agent from reacting within the element at an undesired location or at an undesired point in time. In particular, it is undesirable for oxidized developer to diffuse away from the imaging layer in which it formed and into other color records where it can form dye in the wrong layer. In some formats, it can also be undesirable for toe scale and fog considerations to have oxidized developer form dye at early stages of development. Typically, scavengers reduce or eliminate oxidized developers without forming any permanent dyes and do not cause stains nor release fragments that have photographic activity. They are also typically rendered substantially mobile in the element by incorporation of an anti-diffusion group (a ballast) or by attachment to a polymer backbone.

Known scavengers for oxidized developers include ballasted hydroquinone (1,4-dihydroxybenzene) compounds as described in U.S. Pat. Nos. 3,700,453 and 4,732,845; ballasted gallic acid (1,2,3-trihydroxybenzene) compounds as described in U.S. Pat. No. 4,474,874; ballasted sulfonamidophenols as described in U.S. Pat. Nos. 4,205,987 and 4,447,523; and ballasted resorcinol (1,3-dihydroxybenzene) compounds as described in U.S. Pat. No. 3,770,431. Such known materials are insufficient in their activity, requiring high material usage, thus increasing cost, storage and handling concerns as well as requiring thicker layers, thus degrading sharpness through increased scatter path length. In addition, because these known materials are sensitive to oxidative conditions, they are often insufficiently stable upon long term storage. Finally, many of these materials form stains or colored residues during processing.

It is also known to use certain hydrazide compounds as scavengers for oxidized developing agents as described, for example, in U.S. Pat. Nos. 4,923,787, 4,971,890, 5,147,764, 5,164,288 and 5,230,992 and in Japanese Patent Publication No. 4-238347, published Aug. 26, 1992. However, these hydrazide compounds suffer from many of the same disadvantages and deficiencies as the hydroquinone, gallic acid, sulfonamidophenol and resorcinol compounds. In particular, these hydrazide compounds are especially deficient in regard to activity and long-term storage stability.

Japanese Patent Publication No. 61-248042, published Nov. 5, 1986, describes the use of certain pyrocatechol derivatives to improve raw stock storability of photographic elements. However, these derivatives are not ballasted and do not function as effective scavengers for oxidized developing agent.

U.S. Pat. No. 4,175,968 discloses the use as scavengers for oxidized developing agent of pyrocatechol compounds of the formula:

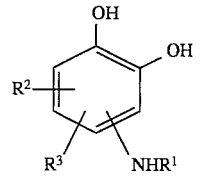

wherein $R^1$ is an acyl group and $R^2$ and $R^3$ are hydrogen, alkyl, halogen, sulfo or carboxyl. However, such compounds are insufficiently reactive and are associated with excessive levels of red stain.

U.S. Pat. No. 4,252,893 discloses the use as scavengers for oxidized developing agent of pyrocatechol compounds of the formula:

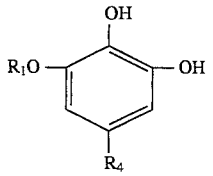

wherein $R_1$ is alkyl, alkenyl or acyl and $R_4$ is halogen, alkyl, alkenyl, cycloalkyl, cyano, $—SO_2R_5$ or $—COR_5$ where $R_5$ is hydrogen, hydroxy, alkyl, alkoxy, cycloalkoxy, aryloxy or amino. Such compounds provide useful results but improved activity and greater stability are desired to facilitate their commercial utilization.

U.S. Pat. No. 4,476,219 discloses the use as scavengers for oxidized developing agent of gallic acid amide derivatives (1,2,3-trihydroxy-5-carbamoylbenzenes) of the formula:

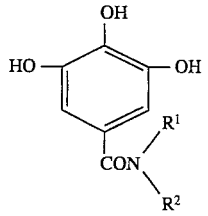

wherein $R^1$ and $R^2$ each represents a hydrogen atom, a substituted or unsubstituted aliphatic group, a substituted or unsubstituted aromatic group, or a substituted or unsubstituted heterocyclic group with the proviso that they are not both hydrogen atoms and the further proviso that they can combine with each other to form a ring. Such gallic acid amide derivatives suffer from the disadvantage that they form colored stains in both Dmin and Dmax areas to a degree that hinders their commercial utilization.

U.S. Pat. No. 2,675,314 discloses the development of a silver halide emulsion, containing one or more color couplers, with a primary aromatic amino developing agent in the presence of an antistaining agent of the formula:

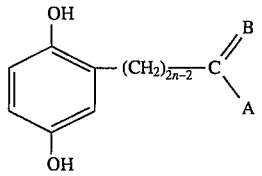

in which A is hydrogen, alkyl, —$NH_2$, —NHR, —$NR_2$ or —OR;

R is alkyl;

B is =NOH or =O and n is 1 or 2. Such compounds would tend to diffuse throughout a photographic element and would therefore not be effective as scavengers for oxidized developing agent.

U.S. Pat. No. 5,264,332 discloses silver halide color photographic materials which can contain in a red-sensitized silver halide emulsion layer for the purpose of preventing leuco cyan dye formation a compound of the formula:

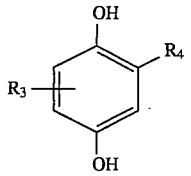

wherein $R_3$ is a hydrogen atom, an alkyl group or a halogen atom and $R_4$ is alkyl, aryl, alkoxy, aryloxy, alkylthio, arylthio, amido, acyl, alkoxycarbonyl, carbamoyl, sulfamoyl or sulfoxido. The prevention of leuco cyan dye formation and the scavenging of oxidized developing agent are, however, distinctly different functions which operate by different mechanisms and compounds which function to prevent leuco cyan dye formation are not necessarily effective to act as scavengers.

It is an objective of this invention to provide a new class of reactive scavengers for oxidized developer which can be incorporated in a wide range of photographic elements, and especially in color elements to prevent color contamination between layers, to prevent stain and to reduce fog. It is a particular objective of this invention to provide a new class of reactive scavengers that have high activity, that have excellent stability upon long-term storage and that do not leave colored residues after processing.

SUMMARY OF THE INVENTION

In accordance with this invention, a photographic element comprises a support bearing at least one silver halide emulsion layer having associated therewith a hydroquinone compound that functions as a scavenger for oxidized developing agent; wherein the hydroquinone compound has sufficient bulk that it is substantially non-diffusible in the photographic element and has in the two-position thereof an asymmetric tertiary carbamoyl substituent.

Hydroquinone, which is also referred to as p-dihydroxybenzene or as 1,4-dihydroxybenzene, has the formula:

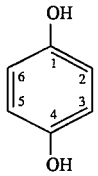

In the hydroquinone compounds utilized in this invention, the 2-position is substituted with an asymmetric tertiary carbamoyl group. A carbamoyl group is a group of the formula:

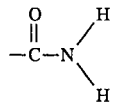

By the term "an asymmetric tertiary carbamoyl group," as employed herein, is meant a carbamoyl group in which all three valence bonds of the nitrogen atom thereof are connected to carbon atoms and in which the two substituents in addition to the carbonyl

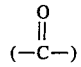

substituent, are not identical, such as, for example, a group of the formula:

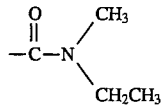

In the hydroquinone compounds utilized in this invention, the required bulk is provided by at least one ballasting group attached to the hydroquinone ring or to the nitrogen atom of the asymmetric tertiary carbamoyl group. Particularly preferred ballasting groups are those containing 12 to 30 carbon atoms.

In accordance with a preferred embodiment of this invention, a photographic element comprises a support bearing at least one silver halide emulsion layer having associated therewith a hydroquinone compound that functions as a scavenger for oxidized developing agent; wherein the hydroquinone compound is represented by the formula:

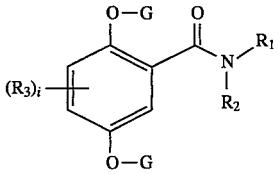

wherein:

each G, independently, represents a hydrogen atom or a labile group which is cleaved from the oxygen to which it is attached during processing of the photographic element;

$R_1$ and $R_2$, taken separately, independently represent alkyl, substituted alkyl, aryl, substituted aryl, alkaryl or aralkyl with the proviso that $R_1$ and $R_2$ are not identical;

$R_3$ represents halogen, alkyl, substituted alkyl, aryl, substituted aryl, aralkyl, alkaryl, alkyloxy or aryloxy; and i is 0, 1, 2 or 3;

with the proviso that two or more of $R_1$, $R_2$ and $R_3$ can be joined together to form a ring system and with the further proviso that at least one of $R_1$, $R_2$ and $R_3$ includes a ballasting group.

The hydroquinone compounds utilized in this invention are 2-(N,N-disubstituted-carbamoyl)-hydroquinones. They have been unexpectedly found to exhibit a unique combination of high activity, long-term stability and minimal propensity to form stains when employed in photographic elements as scavengers for oxidized developing agent.

In a particularly preferred embodiment of this invention, the photographic element comprises at least one non-light-sensitive layer in addition to at least one silver halide emulsion layer and the hydroquinone compound is incorporated in a non-light-sensitive layer.

DETAILED DESCRIPTION OF THE INVENTION

Scavengers are compounds which react with oxidized developing agents by mechanisms such as cross-oxidation or coupling and deactivate the oxidized developing agent without forming permanent image. They can be incorporated within a silver halide emulsion layer to control curve shape. They can be incorporated within an interlayer to provide improved color reproduction.

The hydroquinone compounds of this invention are highly effective scavengers which are utilized in association with a silver halide emulsion layer, by which is meant that they can be incorporated in a silver halide emulsion layer or in any other layer of a photographic element from which they can modify the characteristics of a silver halide emulsion layer. They are most preferably incorporated within an interlayer of a color element to provide improved color reproduction.

As hereinabove described, preferred hydroquinone compounds employed in this invention are represented by the general formula:

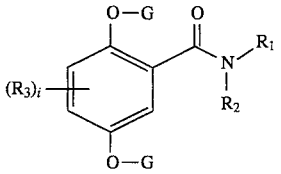

In the above formula, each G independently represents a hydrogen atom or a labile group which is cleaved from the oxygen to which it is attached during processing of the photographic element. Thus, both G groups can be hydrogen or both can be labile groups or one can be hydrogen and the other can be a labile group.

The labile groups form hydroxyl groups upon processing of the photographic element. Examples of such labile groups include alkyl esters, sulfonyl esters, carbamates, phosphates and carbonates. The labile groups are alkali-decomposable groups in which the hydrogen atom of an hydroxyl group has been substituted with a blocking group that is eliminated upon contact with an alkali. A typical blocking group is one that can be eliminated by hydrolysis or intermolecular nucleophilic substitution. Typical examples of the blocking group that can be eliminated by hydrolysis include acyl groups such as aliphatic and aromatic carbonyl groups, and a sulfonyl group. Exemplary blocking groups are described in U.S. Pat. Nos. 4,310,612, 4,358,525, 4,554,243 and 4,690,885.

$R_1$ and $R_2$, taken separately, independently represent alkyl such as methyl, ethyl, butyl or octyl; substituted alkyl; aryl such as phenyl or naphthyl; substituted aryl, alkaryl such as tolyl, or aralkyl such as benzyl or phenethyl with the proviso that $R_1$ and $R_2$ are not identical. Useful alkyl groups include those of up to 30 carbon atoms, while useful aryl groups include those containing six to eighteen carbon atoms. Examples of substituent groups with which the alkyl and/or aryl groups represented by $R_1$ and $R_2$ can be substituted include halo, cyano, alkoxy, aryloxy, hydroxy and nitro. It is preferred that one of $R_1$ and $R_2$ is an n-octadecyl group ($—C_{18}H_{37}—n$)

$R_3$ represents halogen such as chloro; alkyl such as methyl, ethyl, butyl or octyl; substituted alkyl such as chloromethyl; aryl such as phenyl or naphthyl; substituted aryl such as methoxyphenyl; alkaryl such as tolyl; aralkyl such as benzyl or phenethyl; alkyloxy such as methoxy, ethoxy or propoxy; and aryloxy such as benzoxy. $R_3$ cannot be a group which is capable of serving as an additional oxidation site on the hydroquinone, such as an hydroxy, amino, acylamino (—NH—COR) or sulfonamido ($—NHSO_2R$)group.

At least one of $R_1$, $R_2$ and $R_3$ includes a ballasting group, by which is meant a group of sufficient bulk and hydrophobicity that the hydroquinone compound is immobilized in the photographic element and is not appreciably soluble in water or in an aqueous alkaline photographic developing solution.

In order to avoid excessive hydrophobicity (which decreases activity) but still prevent wandering of the hydroquinone compound in the photographic element during long-term storage, it is preferred that the molecular weight of the hydroquinone compound utilized in this invention be greater than 250 but less than 650. As is well known in the art, the overall hydrophobicity of a ballasted compound can be adjusted by inclusion of water-solubilizing or polar groups, such as carboxylic acid groups, sulfonic acid groups, ether groups and amido groups, while still retaining enough bulk to maintain anti-diffusion properties.

If $R_1$ and $R_2$ in the above formula are both unsubstituted alkyl groups, then it is preferred that the sum of the carbon atoms in $R_1$ and $R_2$ is 20 or less in order to maintain good activity by preventing excessive hydrophobicity.

Particularly preferred hydroquinone compounds for use in this invention are those of the formula:

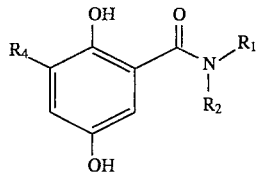

wherein:

$R_1$ and $R_2$, taken separately, independently represent alkyl, substituted alkyl, aryl, substituted aryl, alkaryl or aralkyl with the proviso that $R_1$ and $R_2$ are not identical; and $R_4$ is hydrogen, alkyl of 1 to 8 carbon atoms, or alkyloxy of 1 to 8 carbon atoms; with the proviso that $R_1$ and $R_2$ can be joined together to form a ring system and with the further proviso that at least one of $R_1$ and $R_2$ includes a ballasting group.

Examples of hydroquinone compounds that are usefully employed as scavengers in the photographic elements of this invention include the following:

S-1:

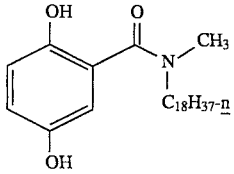

S-2:

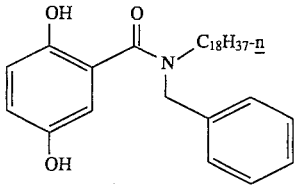

S-3
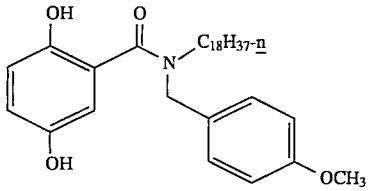
S-4:
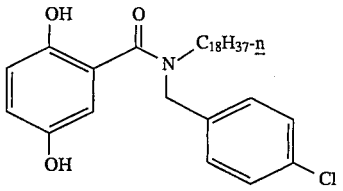
S-5:
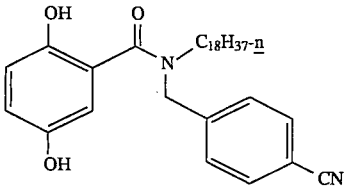
S-6:
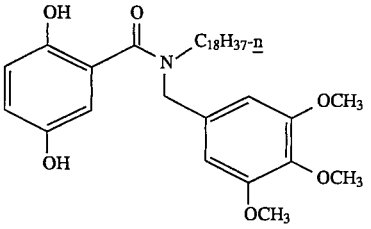
Scavengers outside of the scope of the present invention which have been evaluated herein for purposes of comparison include the following:
CS-1:
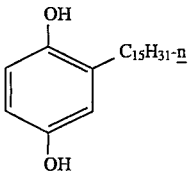
CS-2:
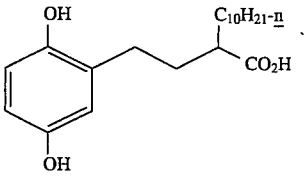
CS-3:
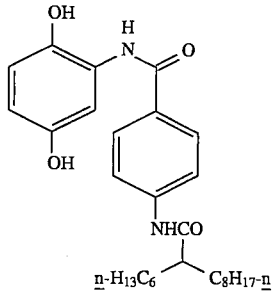
CS-4:
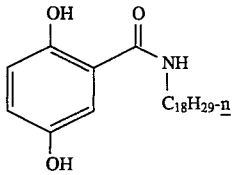
CS-5:
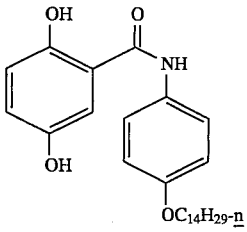
CS-6:
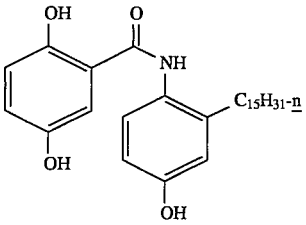
CS-7:
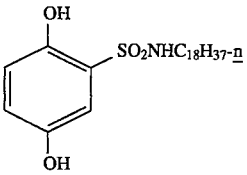
CS-8:
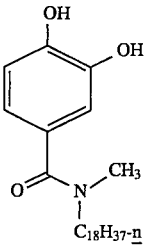
CS-9:
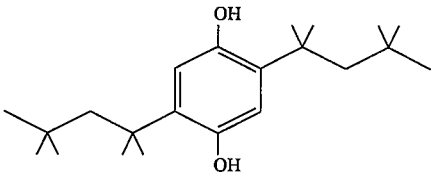

-continued

CS-10:

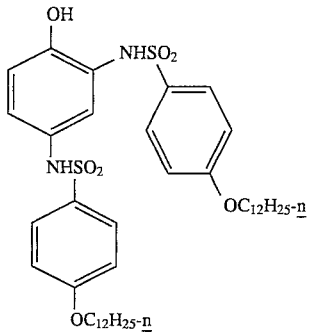

CS-11:

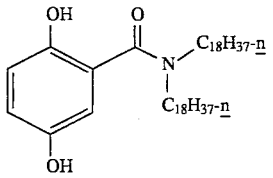

CS-12:

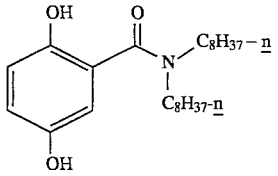

CS-13:

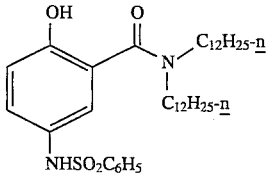

CS-14:

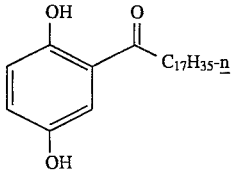

-continued

CS-15:

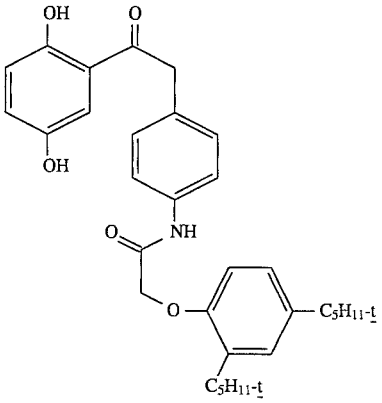

The photographic elements of the present invention can be simple black-and-white or monochrome elements comprising a support bearing a layer of silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a hydroquinone compound that functions as a scavenger in accordance with this invention. Preferably the scavenger is incorporated in an interlayer between silver halide emulsion layers sensitive to different regions of the visible spectrum, although it can be incorporated in an interlayer between silver halide emulsion layers sensitive to the same region of the visible spectrum. The scavenger can be incorporated in layers which also have other functions, such as, for example, antihalation layers or filter layers.

In addition to emulsion layers and interlayers, the elements of the present invention can contain auxiliary layers conventional in photographic elements, such as overcoat layers, spacer layers, filter layers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The amount of scavenger compound employed will depend upon the particular purpose for which the scavenger is to be used and the degree of scavenging desired. Typically useful results are obtained when the scavenger is employed in an amount of between about 5 and 2000 mg/square meter.

The hydroquinone compound is typically incorporated in the photographic element with the aid of a suitable solvent such as a coupler solvent. Examples of preferred coupler solvents that can be utilized for this purpose in this invention include:

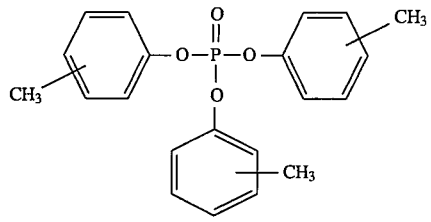
SOL-1

(mixture of ortho, meta and para isomers)

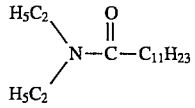
SOL-2

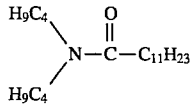
SOL-3

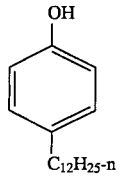
SOL-4

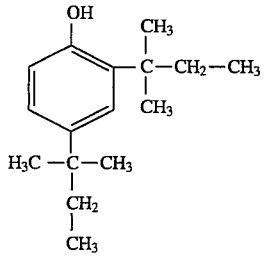
SOL-5

$O{=}P(OC_6H_{13}\text{-}n)_3$ SOL-6

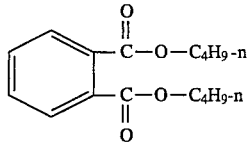
SOL-7

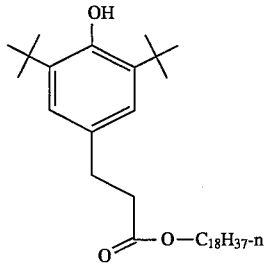
SOL-8

In the practice of this invention, it is desirable to incorporate a surfactant in one or more layers of the photographic element. Examples of useful surfactants include nonionic surfactants such as SURFACTANT 10G from OLIN MATHIESON CORPORATION and anionic surfactants such as TRITON X-200E from ROHM AND HAAS CORPORATION or AEROSOL OT from AMERICAN CYANAMID COMPANY.

The problem of sensitizing dye stain, which is minimized or avoided by the use of a scavenger in accordance with this invention, is particularly severe with photographic elements utilizing tabular grain silver halide emulsions because such emulsions typically employ very high levels of sensitizing dye. However, because of their other advantageous characteristics use of tabular grain silver halide emulsions represents a particularly important embodiment of this invention.

Specifically contemplated tabular grain emulsions for use in this invention are those in which greater than 50 percent of the total projected area of the emulsion grains is accounted for by tabular grains having a thickness of less than 0.3 micron and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 micron.

As noted above, tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

In a particularly preferred embodiment, the present invention provides a multicolor photographic element capable of forming a dye image, which element comprises a support having thereon:

a blue-recording yellow-dye-image forming layer unit, a green-recording magenta-dye-image-forming layer unit, and a red-recording cyan-dye-image-forming layer unit, each of the dye-image-forming layer units comprising at least one silver halide emulsion layer containing at least one sensitizing dye; the element comprising at least one interlayer positioned between dye-image-forming layer units sensitive to different regions of the visible spectrum and the at least one interlayer containing a hydroquinone compound as hereinabove described.

The photographic elements of this invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

In the working examples which follow reference is made to antihalation dyes DYE-1, DYE-2 and DYE-3; yellow-dye-forming couplers Y-1, Y-2 and Y-3; cyan-dye-forming coupler C-1; developer-inhibitor-releasing couplers DIR-1, DIR-2, DIR-3 and DIR-4, masking couplers MC-1 and MC-2; bleach-accelerator releasing coupler B-1; ultraviolet-absorbing agents UV-1 and UV-2; red-sensitizing dyes RSD-1, RSD-2 and RSD-3; green-sensitizing dyes GSD-1 and GSD-2; blue-sensitizing dye BSD-1 and magenta-dye-forming couplers M-1 and M-2. These compounds have structures as indicated below.

DYE-1:

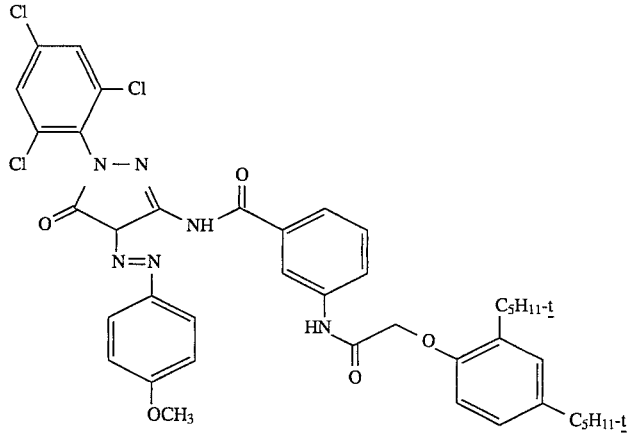

-continued
DYE-2:
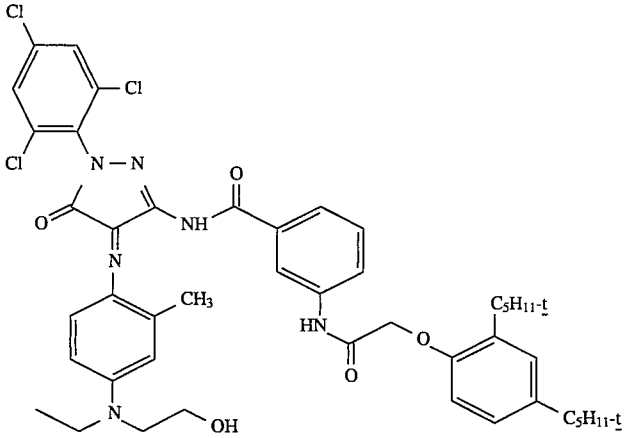
DYE-3:
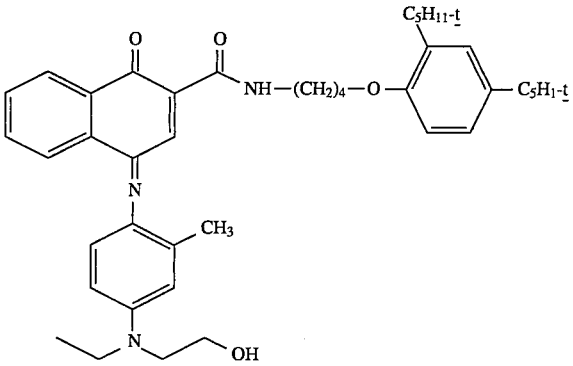
Y-1:
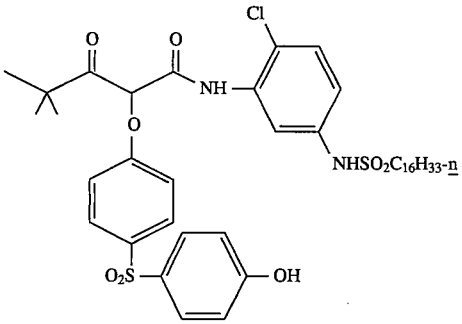
Y-2:
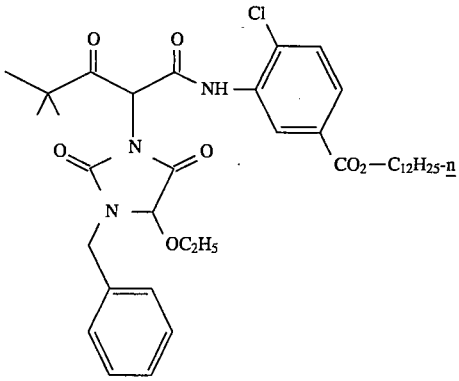

-continued
Y-3:
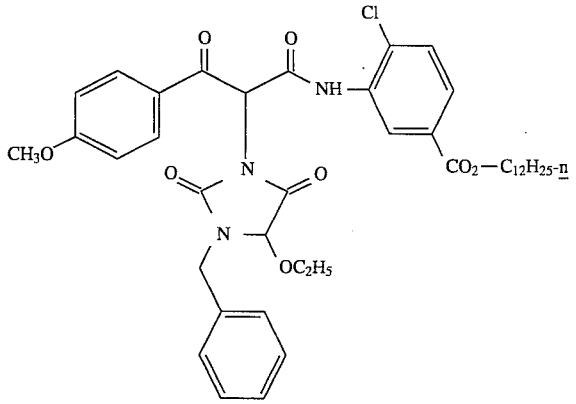
C-1:
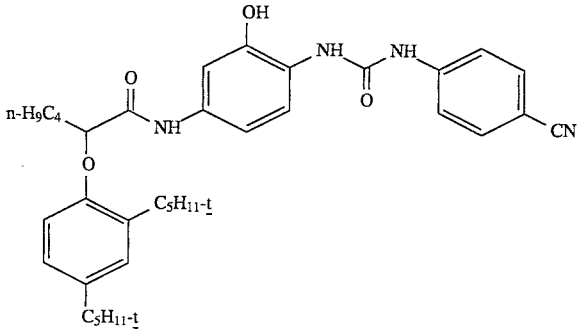
DIR-1:
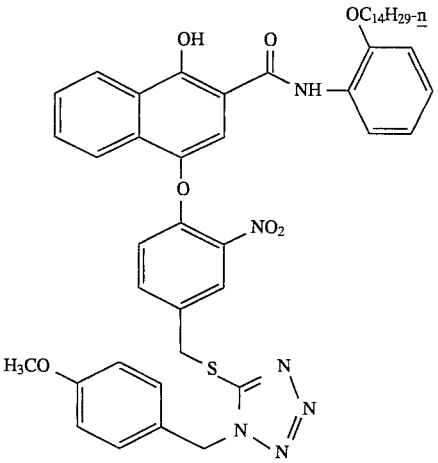
DIR-2:
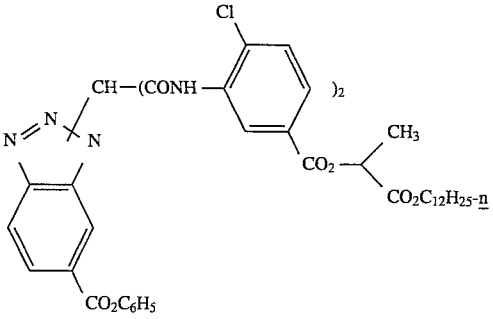

-continued
DIR-3:
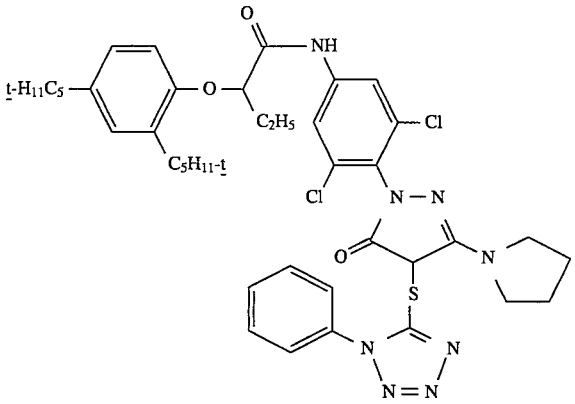
DIR-4:
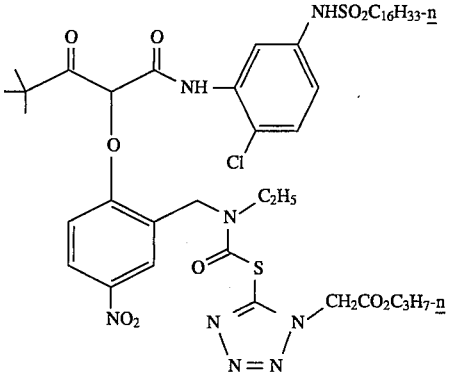
MC-1:
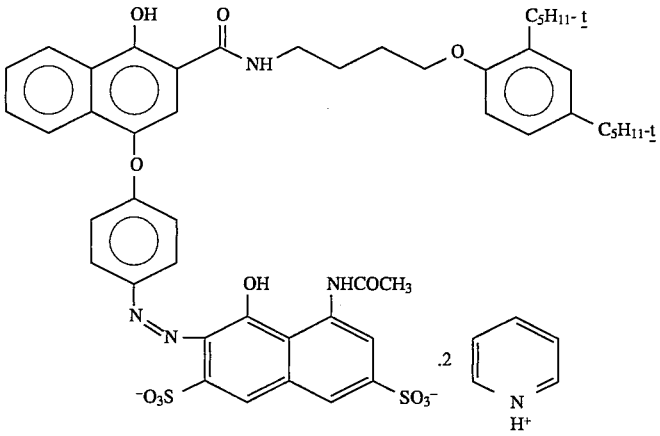

-continued
MC-2:
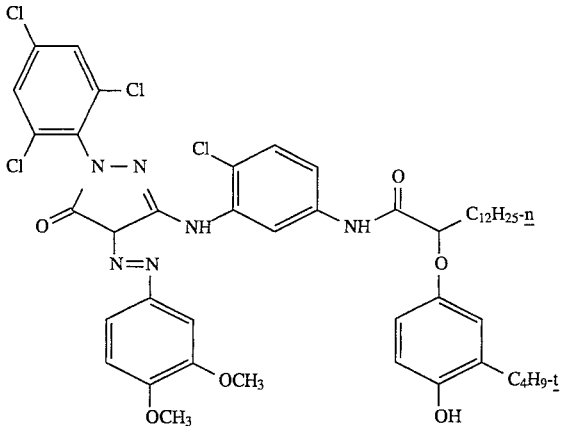
B-1:
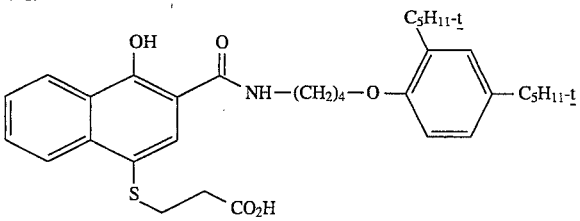
UV-1:
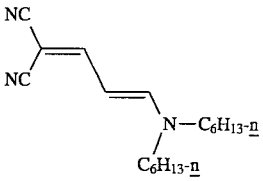
UV-2:
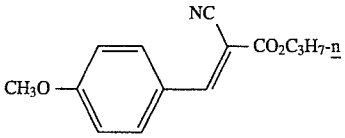
RSD-1:
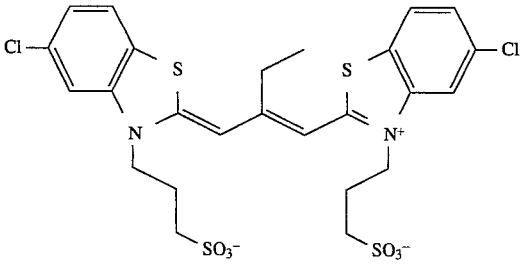
RSD-2:
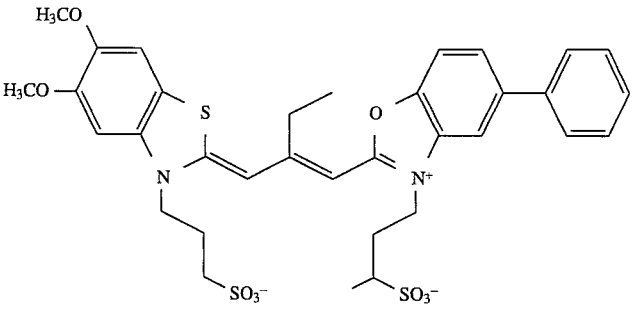

-continued
RSD-3:
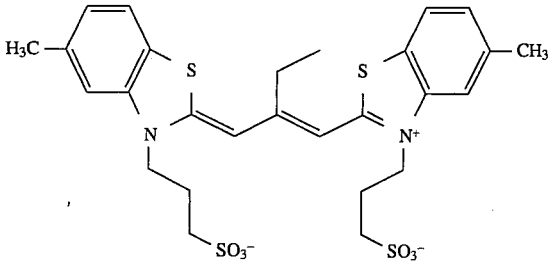
GSD-1:
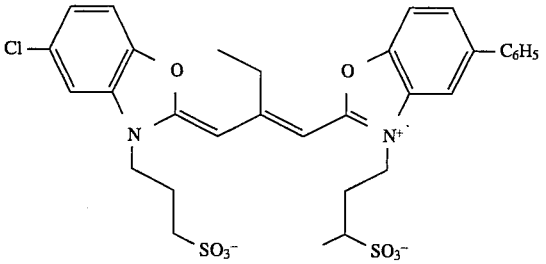
GSD-2:
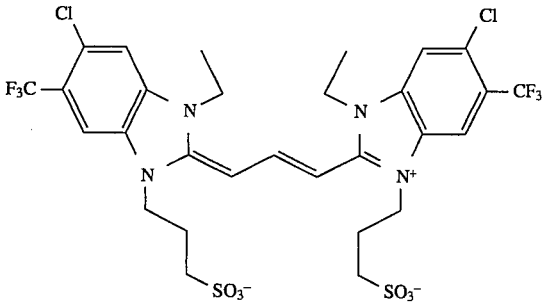
BSD-1:
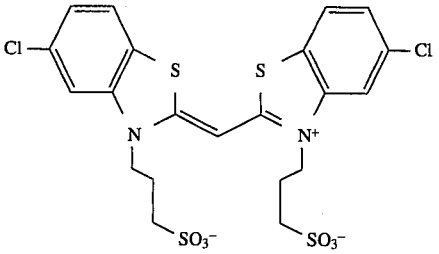
M-1:
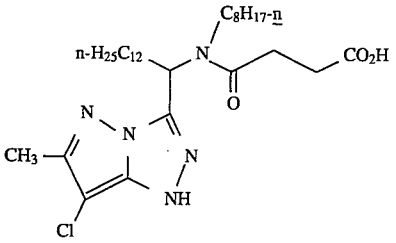

-continued

M-2:

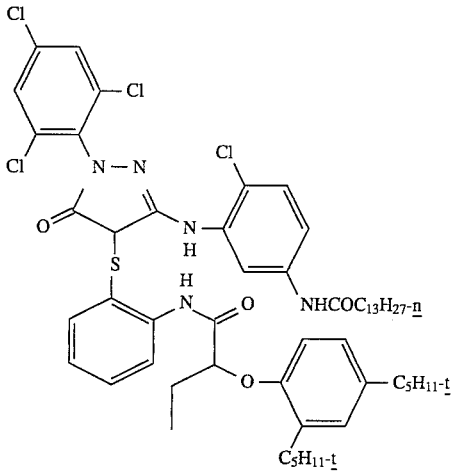

The hydroquinone compounds utilized as scavengers in this invention can be prepared by reactions and methods that are well known in the organic chemistry synthesis art. The following example illustrates the synthesis of hydroquinone compound S-2.

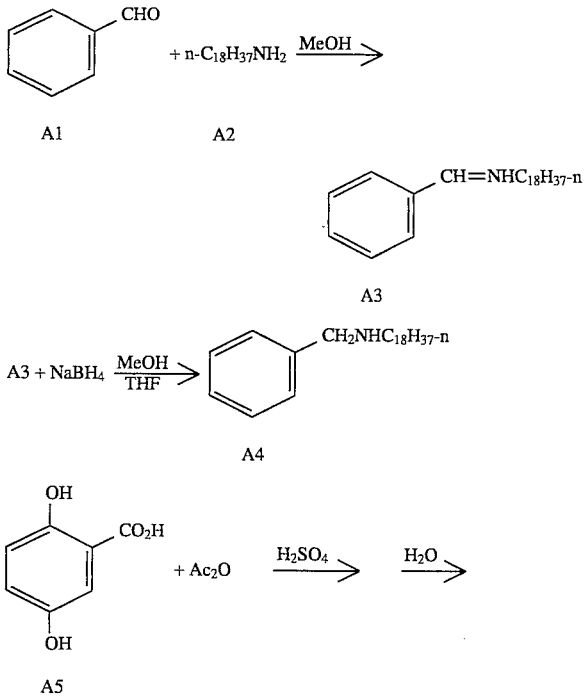

-continued

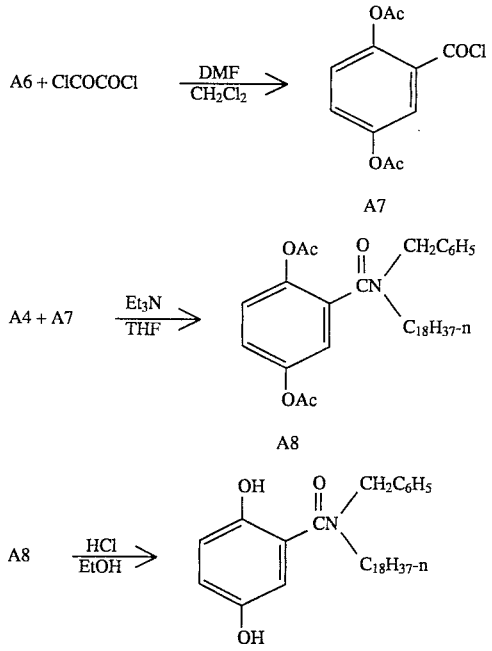

Me herein is methyl
Et herein is ethyl
THF herein is tetrahydrofuran
Ac herein is acetyl
DMF herein is N,N-dimethylformamide

Compound A3

Benzaldehyde A1 (10.6 g, 0.10 mol) and n-octadecylamine A2 (27.0 g, 0.10 mol) were mixed in methanol (400 mL). The mixture was stirred and heated to reflux for 2 hours. The resulting hot solution was chilled in an ice bath. The cold mixture was filtered and the collected solid was washed with cold methanol. The product was dried in a vacuum oven at room temperature under nitrogen overnight. This gave compound A3 as a fluffy white solid, m.p. 33°–35°. Yield 31.8 g (89%).

Compound A4

Compound A3 (31.5 g, 0.088 mol) was mixed with absolute methanol (125 mL) and dry tetrahydrofuran (125 mL). The mixture was stirred at room temperature under a nitrogen atmosphere to form a solution. The reaction flask was chilled in an ice bath until the pot temperature was 10°. Sodium borohydride (3.6 g, 0.095 mol) was added in portions over 15 minutes. Gas evolution and foaming occurred. The ice bath was removed and the mixture was stirred at room temperature for 2 hours. Excess sodium borohydride was destroyed by slowly adding acetic acid (2 mL). The resulting mixture was poured into ice and water (800 mL). The aqueous mixture was filtered through glass fiber filter paper. The collected solid was washed with water. The product was dried in a vacuum oven over phosphorus pentoxide at room temperature overnight. This gave compound A4 as a white amorphous solid, m.p. 37°–39°. Yield 31.0 g (98%).

Compound A6

2,5-Dihyroxybenzoic acid (15.4 g, 0.10 mol) was mixed with acetic anhydride (102.0 g, 1.00 mol). The resulting suspension was stirred and warmed slightly. Concentrated sulfuric acid (5 drops) was added. The mixture was stirred and heated to 75°–80° for 5 minutes. The resulting warm solution was poured with stirring into water (400 mL). The aqueous mixture was stirred vigorously and was heated to 55°–60° for 20 minutes. After approximately 5 minutes a clear solution formed. This solution was allowed to cool to room temperature, then it was extracted 3 times with ethyl acetate. The extracts were combined and were washed 4 times with water, and then were washed 2 times with saturated sodium chloride solution. The extracts were dried over magnesium sulfate. The extracts were filtered and the solvent was removed on a rotary evaporator. This gave a solid which was stirred in pentane at room temperature for approximately 10 minutes. This mixture was filtered and the collected solid was washed with fresh pentane. The product was dried in a vacuum oven at approximately 45° under nitrogen overnight. This gave compound. A6 as a white solid, m.p. 113°–116°. Yield 19.9 g (84%).

Compound A7

Compound A6 (10.3 g, 0.043 mol) and oxalyl chloride (6.4 g, 0.050 mol) were mixed with dichloromethane (125 mL). The mixture was stirred at room temperature to form a solution. N,N-Dimethylformamide (4 drops) was added and gas evolution occurred. Gas evolution ceased after 2 hours. The solvent and excess oxalyl chloride were removed on a rotary evaporator. The remaining residue was redissolved in fresh dichloromethane (125 mL). The solvent was again removed on the rotary evaporator. This gave A7 as a yellow oil. Yield 11.0 g (100%). The product was used immediately without further purification.

Compound A8

Compound A7 (11.0 g, 0.043 mol) was dissolved in dry tetrahydrofuran (250 mL). This solution was stirred at room temperature under a nitrogen atmosphere. Compound A4 (15.5 g, 0.043 mol) was added in portions over 10 minutes. The mixture was stirred at room temperature for 1 hour. Then a solution of triethylamine (4.3 g, 0.043 mol) in dry tetrahydrofuran (50 mL) was added dropwise over 20 minutes. After this addition was completed the mixture was stirred at room temperature for 2 hours. The reaction mixture was poured with stirring into a mixture of ice and water (800 mL) and concentrated hydrochloric acid (50 mL). The product oiled out of solution. The aqueous mixture was extracted 3 times with ethyl acetate. The extracts were combined and were washed twice with saturated sodium chloride solution. The extracts were dried over magnesium sulfate. This mixture was filtered and the solvent was removed from the filtrate on a rotary evaporator. This gave a clear colored oil which was stirred with ligroin (120 mL, boiling point 63°–75° C.) at room temperature overnight. The product crystallized during this period. The mixture was filtered and the collected solid was washed first with ligroin and then was washed with pentane. The product was dried in a vacuum oven at approximately 40° under nitrogen for several hours. This gave compound A8 as a white powder, m.p. 73°–75°. Yield (79%). An nmr spectrum and elemental analysis were correct for structure A8.

Compound S-2

Compound A8 (14.5 g, 0.025 mol) and concentrated hydrochloric acid (2.0 g) were mixed with ethanol (200 mL). The mixture was stirred and heated to reflux for 1 hour. All A8 dissolved as the reaction mixture warmed. The reaction solution was cooled to room temperature and then was poured with stirring into ice and water (700 mL). The product separated out as an emulsified semi-solid. The aqueous mixture was extracted 3 times with ethyl acetate. The extracts were combined and were washed twice with saturated sodium chloride solution. The extracts were dried over magnesium sulfate and then were filtered. The solvent was removed from the filtrate on a rotary evaporator. This gave a clear colored oil which solidified on standing. The crude product was recrystallized from acetonitrile (125 mL). The cold mixture was filtered and the collected solid was washed with cold acetonitrile. The product was dried in a vacuum oven at approximately 40° under nitrogen for several hours. This gave S-2 as a white solid, m.p. 75°–78°. Yield 11.4 g (92%). The structure of S-2 was confirmed by its nmr spectrum and by elemental analysis.

EXAMPLES 1–6

Four-layer photographic test elements were prepared by coating a cellulose acetate butyrate film support first with an antihalation layer containing 4.89 g/m$^2$ of gelatin and 0.32 g/m$^2$ of grey colloidal silver followed by a photosensitive layer consisting of 2.42 g/m$^2$ of silver iodobromide emulsion (sensitized with a mixture of RSD-1 and RSD-2), 1.08 g/m$^2$ of yellow-dye-forming coupler Y-1, 0.325 g/m$^2$ of antifoggant 5-methyl-s-triazole-[2,3-a]-pyrimidine-7-ol and 2.15 g/m$^2$ of gelatin. These layers were then overcoated with an interlayer consisting of 0.65 g/m$^2$ of gelatin with 0.007 moles/m$^2$ of the indicated scavenger (dispersed in half its weight of N,N-dibutyllauramide unless otherwise noted) followed by a receiver layer consisting of 2.69 g/m$^2$ of gelatin with 0.33 g/m$^2$ of magenta-dye-forming coupler M-1 and finally, with an overcoat of 5.4 g/m$^2$ of gelatin with bis-vinylsulfonyl methyl ether hardener at 1.75 weight percent based on total gel.

Samples of each element were exposed imagewise through a stepped density test object and subjected to the KODAK FLEXICOLOR(C41) Process as described in *British Journal of Photography Annual,* 1988, pp. 196–198, using fresh unseasoned processing solutions.

In the format of the test element described above, magenta dye can be formed only by the wandering of oxidized developer from the layer in which it is generated through an interlayer to the layer containing the magenta coupler. Thus, the ability of the scavenger to prevent oxidized developer from wandering can be measured by the difference in green density measured at minimum and maximum exposure.

In the following Table I, Delta Green is the (Green density at Dmax—Green density at Dmin of the sample containing the scavenger)—(Green density at Dmax—Green density at Dmin of a check coating without scavenger). More negative values for Delta Green reflect improved scavenging.

Oxidative stability was determined by holding the test elements at 3000 psi pressure at ambient temperature for seven days, then exposing and processing in the manner hereinabove described. Percent scavenger remaining was determined by extraction of the coating, followed by high pressure liquid chromatography using standard analytical techniques.

TABLE I

| Example No. | Scavenger | Delta Green | % Scavenger Remaining |
|---|---|---|---|
| Control 1 | CS-1 | −.145 | — |
| Control 2 | CS-2 | −.109 | — |
| Control 3 | CS-3 | −.146 | 88 |
| Control 4 | CS-4 | −.218 | 99 |
| Control 5 | CS-5 | −.083 | — |
| Control 6 | CS-6 | −.212 | 103 |
| Control 7 | CS-7 | −.120 | 98 |
| Control 8 | CS-8 | −.256 | 100 |
| Control 9 | CS-9* | −.234 | 67 |
| Control 10 | CS-10 | −.201 | 100 |
| Control 11 | CS-11 | −.120 | 101 |
| Control 12 | CS-12 | −.189 | — |
| Control 13 | CS-13 | −.019 | — |
| Control 14 | CS-14 | −.060 | — |
| Control 15 | CS-15 | −.085 | — |
| 1 | S-1 | −.291 | 103 |
| 2 | S-2 | −.238 | 98 |
| 3 | S-3 | −.268 | — |
| 4 | S-4 | −.250 | — |
| 5 | S-5 | −.219 | — |
| 6 | S-6 | −.219 | — |

*Comparison scavenger CS-9 was dispersed in 1.85 times its weight of dibutylphthalate and coated at 0.022 g/m$^2$.
**Comparison scavenger CS-10 was dispersed in half its weight of 2,4-di-t-amylphenol As indicated by the data in Table I, the scavengers of this invention utilized in Examples 1–6 exhibit both superior scavenging ability and excellent oxidative stability. The advantages obtained by the use of an asymmetric tertiary carbamoyl group in contrast with a symmetric tertiary carbamoyl group are demonstrated by comparing the results obtained in Example 1 which employed scavenger S-1 with the results obtained in Controls 11 and 12 which employed comparative scavengers CS-11 and CS-12, respectively. In particular, the delta green value was −0.291 in Example 1 as compared to −0.120 and −0.189 in Controls 11 and 12, thereby indicating greatly superior scavenging ability in Example 1.

EXAMPLE 7

A photographic test element similar to those described hereinabove, designated Control 16, was prepared by coating a cellulose acetate-butyrate film support having an antihalation backing with a layer of 4.89 g/m$^2$ of geltin, followed by a light-sensitive layer containing 1.076 g/m$^2$ of green-sensitized silver iodobromide emulsion and 3.23 g/m$^2$ of gelatin, followed by an overcoat with 5.38 g/m$^2$ of gelatin with bisvinylsulfonyl methyl ether hardener at 1.75 weight % based on total gel. A similar element, designated Control 17, was prepared in which the silver halide emulsion layer contained 0.108 moles/m$^2$ of comparison scavenger CS-8. A similar element, designated Example 7, was prepared in which the silver halide emulsion layer contained 0.108 moles/m$^2$ of inventive scavenger S-1. The elements of Controls 16 and 17 and Example 7 were exposed and processed in the manner hereinbefore described. Density was measured at the wavelengths indicated in Table II below at either minimum exposure (Emin) or maximum exposure (Emax).

TABLE II

| | | 450 nm | | 550 nm | | 650 nm | |
|---|---|---|---|---|---|---|---|
| Example | Scavenger | Emin | Emax | Emin | Emax | Emin | Emax |
| Control 16 | None | .048 | .061 | .035 | .039 | .032 | .033 |
| Control 17 | CS-8 | .127 | .206 | .117 | .152 | .082 | .121 |
| 7 | S-1 | .060 | .160 | .044 | .101 | .037 | .065 |

The results reported in Table II demonstrate that the hydroquinone scavengers of this invention provide exceptionally low stain.

EXAMPLE 8

A multilayer photographic element (designated multilayer control ML-1) was produced by coating the following layers on a cellulose triacetate film support (coverages are in grams per meter squared, emulsion sizes as determined by the disc centrifuge method and are reported in Diameter×Thickness in microns);

Layer 1 (Antihalation layer): black collodial silver sol at 0.140; gelatin at 2.15; CS-9 at 0.108, DYE-1 at 0.049; DYE-2 at 0.017 and DYE-3 at 0.014.

Layer 2 (Slow cyan layer): a blend of three red sensitized (all with a mixture of RSD-1 and RSD-3) silver iodobromide emulsions: (i) a large sized tabular grain emulsion (1.3×0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; gelatin at 1.72 and anti-foggant 4-hydroxy-6-methyl-1,3,3a,7-tetraazaindene at 0.010.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler M-2 at 0.258; gelatin at 1.08 and anti-foggant 4-hydroxy-6-methyl-1,3,3a,7-tetraazaindene at 0.005.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; Coupler M-2 at 0.086; MC-2 at 0.015; DIR-2 at 0.016; gelatin at 2.12 and anti-foggant 4-hydroxy-6-methyl-1,3,3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; Coupler M-2 at 0.059; MC-2 at 0.054 and DIR-3 at 0.003.

Layer 8 (Yellow filter layer): gelatin at 0.86; Carey-Lea silver at 0.043 and CS-10 at 0.054.

Layer 9 (Slow yellow layer): an equal blend of three blue sensitized (with BSD-1) tabular silver iodobromide emulsions (i) 0.50×0.085, 1.5 mole % I (ii) 0.60 diameter, 3% mole I and (iii) 0.68 diameter, 3 mole % I at a total of 0,430; yellow dye forming coupler Y-2 at 0.699; yellow dye forming coupler Y-3 at 0.215; DIR-4 at 0.086; C-1 at 0.097 and gelatin at 2.066.

Layer 10 (Fast yellow layer): two blue sensitized (with BSD-1) tabular silver iodobromide emulsions (i) 3.1×0.137, 4.1 mole % I at 0.396 (ii) 0.95 diameter, 7.1 mole % I at 0.47; Y-3 at 0.131; Y-2 at 0.215; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis(vinylsutfonyl)methane hardener at 1.6% of total gelatin weight.

Surfactants, coating aids, emulsion addenda, sequestrants, lubricants, matte and tinting dyes were added to the appropriate layers as is common in the art.

A second multilayer photographic element (designated multilayer control ML-2) was prepared in the same manner as ML-1 except that an equimolar amount of comparative scavenger CS-9 replaced CS-10 in the yellow filter layer (layer 8).

A third multilayer photographic element (designated multilayer inventive example ML-3) was prepared in the same manner as ML-2 except that an equimolar amount of inventive scavenger S-1 replaced comparative scavenger CS-9 in both the antihalation layer (layer 1) and the yellow filter layer (layer 8).

Multilayer elements ML-1, ML-2 and ML-3 were given a green layer only stepped exposure using a KODAK WRATTEN 74 filter and processed in the same manner as hereinabove described. The red and blue densities were measured at a green density of 1.5, 2.0 and 2.3 (Dmax). Since only the green layer was exposed and is fully developing, the bulk of any blue density will come from diffusion of the oxidized developer formed in the green layer diffusing through the yellow filter layer into the blue layer. Lower density values imply improved scavenging of oxidized developer. The results obtained are summarized in Table III below.

TABLE III

| Example No. | Element | Green D = 1.5 Blue | Green D = 2.0 Blue | Green D = 2.3 Blue |
|---|---|---|---|---|
| Control 18 | ML-1 | .639 | .667 | .738 |
| Control 19 | ML-2 | .696 | .734 | .795 |
| 8 | ML-3 | .620 | .643 | .712 |

As seen in Table III, the multilayer element containing a hydroquinone scavenger of this invention (ML-3) shows less color contamination in the blue record due to oxidized developer wandering into unexposed layers than the multilayer elements (ML-1 and ML-2) that contained scavengers outside the scope of the present invention.

As shown by the above examples, hydroquinone compounds which have the structural features required by this invention are markedly superior to previously known hydroquinone scavengers as well as to other well-known classes of scavenging compounds. The essential structural features include sufficient bulk that the hydroquinone compound is substantially non-diffusible in the photographic element and the presence of an asymmetric tertiary carbamoyl substituent in the 2-position of the hydroquinone ring. Particularly preferred hydroquinone compounds are those having a molecular weight of greater than 250 but less than 650 as this provides a particularly good balance between scavenging activity and long-term storage stability.

The invention has been described in detail, with particular reference to certain preferred embodiments thereof, but it should be understood that variations and modifications can be effected within the spirit and scope of the invention.

We claim:

1. A photographic element comprising a support bearing at least one light-sensitive silver halide emulsion layer having associated therewith a hydroquinone compound that functions as a scavenger for oxidized developing agent; said hydroquinone compound having sufficient bulk that it is substantially non-diffusible in said photographic element and having in the two-position thereof an asymmetric tertiary carbamoyl substituent.

2. A photographic element as claimed in claim 1, wherein said hydroquinone compound has a molecular weight of greater than 250 but less than 650.

3. A photographic element comprising a support bearing at least one silver halide emulsion layer having associated therewith a hydroquinone compound that functions as a scavenger for oxidized developing agent; said hydroquinone compound having the formula:

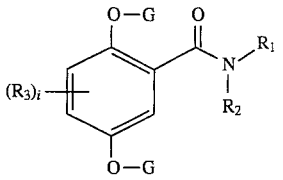

wherein:

each G, independently, represents a hydrogen atom or a labile group which is cleaved from the oxygen to which it is attached during processing of the photographic element;

$R_1$ and $R_2$, taken separately, independently represent alkyl, substituted alkyl, aryl, substituted aryl, alkaryl or aralkyl with the proviso that $R_1$ and $R_2$ are not identical;

$R_3$ represents halogen, alkyl, substituted alkyl, aryl, substituted aryl, aralkyl, alkaryl, alkyloxy or aryloxy; and i is 0, 1, 2 or 3; with the proviso that two or more of $R_1$, $R_2$ and $R_3$ can be joined together to form a ring system and with the further proviso that at least one of $R_1$, $R_2$ and $R_3$ includes a ballasting group.

4. A photographic element as claimed in claim 3, wherein said hydroquinone compound has a molecular weight of greater than 250 but less than 650.

5. A photographic element as claimed in claim 3, wherein each G independently represents a hydrogen atom, an alkyl ester group, a sulfonyl ester group, a carbamate group, a phosphate group or a carbonate group.

6. A photographic element as claimed in claim 3, wherein each G is hydrogen and i is zero.

7. A photographic element as claimed in claim 3, wherein one of $R_1$ and $R_2$ is an n-octadecyl group.

8. A photographic element as claimed in claim 3, wherein $R_1$ and $R_2$ independently represent alkyl or aryl groups substituted with halo, cyano, alkoxy, aryloxy, hydroxy or nitro groups.

9. A photographic element comprising a support bearing at least one silver halide emulsion layer having associated therewith a hydroquinone compound that functions as a scavenger for oxidized developing agent; said hydroquinone compound having the formula:

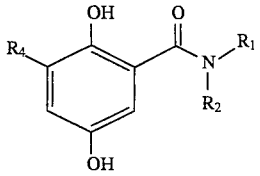

wherein $R_1$ and $R_2$, taken separately, independently represent alkyl, substituted alkyl, aryl, substituted aryl, alkaryl or aralkyl with the proviso that $R_1$ and $R_2$ are not identical; and $R_4$ is hydrogen, alkyl of 1 to 8 carbon atoms, or alkyloxy of 1 to 8 carbon atoms, with the proviso that $R_1$ and $R_2$ can be joined together to form a ring system and with the further proviso that at least one of $R_1$ and $R_2$ includes a ballasting group.

10. A multicolor photographic element comprising a support having thereon:

(1) a blue-recording yellow-dye-image-forming layer unit;

(2) a green-recording magenta-dye-image-forming layer unit; and (3) a red-recording cyan-dye-image-forming layer unit, each of said dye-image-forming layer units containing at least one silver halide emulsion layer comprised of gelatin and silver halide grains and said element additionally comprising a non-light-sensitive layer containing a scavenger for oxidized-color-developing agent; said scavenger being a hydroquinone compound which has sufficient bulk that it is substantially non-diffusible in said photographic element and has in the two-position thereof an asymmetric tertiary carbamoyl group.

11. A multicolor photographic element as claimed in claim 10, wherein said hydroquinone compound has the formula:

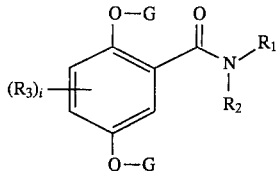

wherein:

each G, independently, represents a hydrogen atom or a labile group which is cleaved from the oxygen to which it is attached during processing of the photographic element;

$R_1$ and $R_2$, taken separately, independently represent alkyl, substituted alkyl, aryl, substituted aryl, alkaryl or aralkyl with the proviso that $R_1$ and $R_2$ are not identical;

$R_3$ represents halogen, alkyl, substituted alkyl, aryl, substituted aryl, aralkyl, alkaryl, alkyloxy or aryloxy; and i is 0, 1, 2 or 3; with the proviso that two or more of $R_1$, $R_2$ and $R_3$ can be joined together to form a ring system and with the further proviso that at least one of $R_1$, $R_2$ and $R_3$ includes a ballasting group.

12. A multicolor photographic element as claimed in claim 11, wherein said hydroquinone compound has a molecular weight of greater than 250 but less than 650.

13. A photographic element as claimed in claim 1, wherein said hydroquinone compound is incorporated in said photographic element in an amount of between about 5 and 2000 mg/square meter.

14. A photographic element as claimed in claim 1, wherein said hydroquinone compound has the formula:

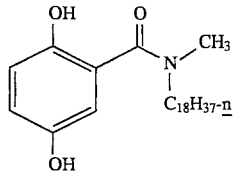

15. A photographic element as claimed in claim 1, wherein said hydroquinone compound has the formula:

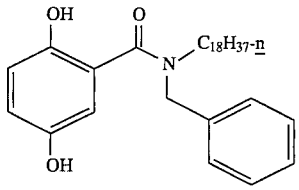

16. A photographic element as claimed in claim 1, wherein said hydroquinone compound has the formula:

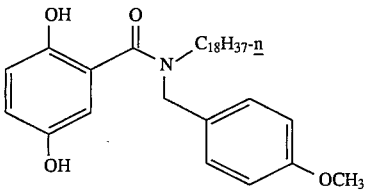
17. A photographic element as claimed in claim 1, wherein said hydroquinone compound has the formula:
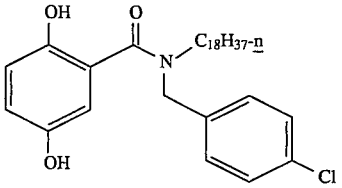
18. A photographic element as claimed in claim 1, wherein said hydroquinone compound has the formula:
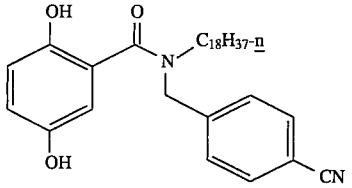
19. A photographic element as claimed in claim 1, wherein said hydroquinone compound has the formula:
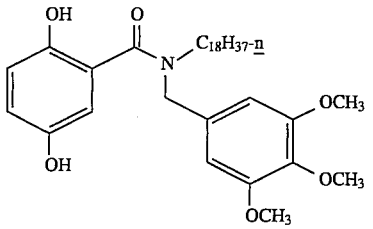
* * * * *